United States Patent [19]

Nakashima

[11] 4,405,289

[45] Sep. 20, 1983

[54] APPARATUS FOR PUMPING A POWDERY OR GRANULAR MATERIAL

[76] Inventor: Shigeo Nakashima, No. 7-7, Tanjinnomori, Morimoto-cho, Muko, Kyoto, Japan

[21] Appl. No.: 292,925

[22] Filed: Aug. 14, 1981

[30] Foreign Application Priority Data

Aug. 31, 1980 [JP] Japan ..... 55-121429

[51] Int. Cl.[3] ..... F04B 3/00

[52] U.S. Cl. ..... 417/250; 406/98; 417/259; 417/900

[58] Field of Search ..... 417/244, 259–264, 417/250, 268, 87, 900; 406/96, 98; 198/721, 747

[56] References Cited

U.S. PATENT DOCUMENTS

| | | | |
|---|---|---|---|
| 251,956 | 1/1882 | Shaffer | 417/262 |
| 2,408,765 | 10/1946 | Erickson | 417/259 |
| 3,010,232 | 11/1961 | Skakel et al. | 417/87 X |
| 3,423,131 | 1/1969 | Weeks | 406/98 X |

FOREIGN PATENT DOCUMENTS

| | | | |
|---|---|---|---|
| 218456 | 3/1942 | Switzerland | 417/259 |
| 202600 | 8/1923 | United Kingdom | 417/259 |

*Primary Examiner*—Edward K. Look
*Attorney, Agent, or Firm*—Wenderoth, Lind & Ponack

[57] ABSTRACT

Apparatus for pumping a powdery or granular material has a first cylinder and a second cylinder parallel to each other and each having a front end and a rear end, a connector box connecting the respective rear ends of the cylinders for placing them in communication, a material inlet at the front end of the first cylinder, a material outlet at the front end of the second cylinder, a first piston in the first cylinder and a first piston rod connected thereto and extending out of the first cylinder, a second piston in the second cylinder and a second piston rod connected thereto and extending out of the cylinder, and a reciprocating drive connected to the piston rods for reciprocating the pistons simultaneously in the same directions within the respective cylinders, the pistons each having openings therethrough and a first one-way valve on the first piston normally closing the opening therein and opening when the first piston is moving in the forward direction and a second one-way valve on the second piston normally closing the opening therein and opening when the second piston is moving in the rearward direction.

7 Claims, 7 Drawing Figures

APPARATUS FOR PUMPING A POWDERY OR GRANULAR MATERIAL

This invention relates to an apparatus for pumping a powdery or granular material.

BACKGROUND OF THE INVENTION AND PRIOR ART

A so-called Kinyon pump or a rotary-type air locker combined with a low- or medium-pressure Roots blower is well known as means for pumping a powdery or granular material. However such pumps are not widely utilized, because the Kinyon pump has the defect that it causes considerable damage to the powdery or granular material due to the sealing system thereof, and also that it requires a comparatively large amount of power. The rotary air locker system has the defects that the mixing ratio (weight ratio of air to pumped material) is small, the efficiency is low, air loss is inevitable due to the structure of the air locker, it is not possible to utilize the rotary-type air locker with all kinds of powdery or granular material, the expense of recovering the powdered material at the exit end due to the low mixing ratio thereof is high, it is useful only for comparatively short distances of transmission, etc. A batch system of pumping is also known, such as the Seller-type and Flaxo-type systems, both of which are operated by alternately connecting therewith a plurality of batch tanks for carrying out a continuous operation, so that economy of operation cannot be obtained except in a large scale plant.

BRIEF SUMMARY OF THE INVENTION

The present invention provides a novel apparatus for pumping a powdery or granular material, wherein the defects of the prior art means for pumping such a powdery material are eliminated, the efficiency of the system is high, the ratio of mixing is large, continuous operation is feasible because it does not use a batch system, it is useful for a larger or for a smaller amount of material depending on demand, and pumping can be carried out over a long distance. Accordingly, the apparatus of the invention is a highly economical means for transportation of any powdery or granular material.

The apparatus provided according to the invention comprises a first cylinder and a second cylinder parallel to each other and each having a front end and a rear end, a connector box connecting the respective rear ends of said cylinders for placing them in communication, a material inlet means at the front end of said first cylinder, a material outlet means at the front end of said second cylinder, a first piston in said first cylinder and a first piston rod connected thereto and extending out of said first cylinder, a second piston in said second cylinder and a second piston rod connected thereto and extending out of said second cylinder, means connected to said piston rods for reciprocating said pistons simultaneously in the same directions within the respective cylinders, said pistons each having openings therethrough and a first one-way valve means on said first piston normally closing the opening therein and opening when said first piston is moving in the forward direction and a second one-way valve means on said second piston normally closing the opening therein and opening when said second piston is moving in the rearward direction.

BRIEF DESCRIPTION OF THE DRAWINGS

The invention will now be described in greater detail in connection with the accompanying drawings, in which.

DETAILED DESCRIPTION OF THE INVENTION

Figure 1:
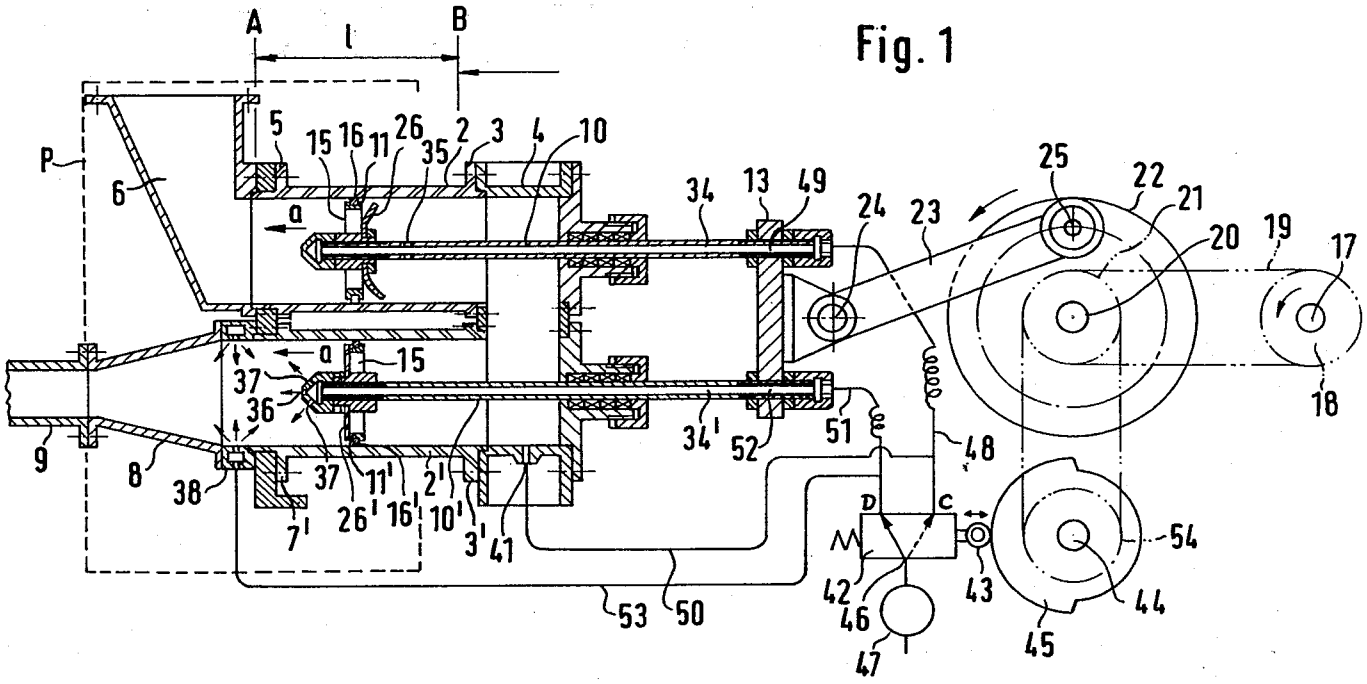
FIG. 1 is a schematic view of the device according to this invention, wherein the cylinders are illustrated in longitudinal section, with the pistons being moved forwards.

The device according to this invention has parallel first and second cylinders 2 and 2' with the rear ends 3 and 3' connected to each other by a hollow cylindrical connector box 4. The forward end 5 of the first cylinder 2 (the upper cylinder) is connected to a material inlet 6 and the forward end 7 of the second cylinder 2' (the lower cylinder) is connected through an air flange 38 and a material outlet funnel 8 to a transport pipe 9. In the first and second cylinders 2 and 2' are disposed first and second pistons 11 and 11' having piston rods 10 and 10' connected therewith, respectively, said pistons being adapted to make a similar horizontal reciprocation through a stroke l between dead center points A and B in accordance with the motion of the piston rods 10 and 10'.

The piston rods 10 and 10' are connected with each other by means of a connector bar 13, to which the respective rear ends 49 and 52 of the piston rods are connected, so that both piston rods 10 and 10' move through their strokes together between the dead center points A and B. Further, the pistons 11 and 11' are provided with a plurality of openings 15 and 15' (four openings in this embodiment as seen in FIG. 4) through which material is propelled and, as seen clearly in FIG. 3, packing rings 16 and 16' are inserted into the slots in the peripheries of the pistons 11 and 11' to form tight seals against the inner walls of the cylinders 2 and 2'.

In operation, power in the form of rotation of a motor shaft 17 is transmitted from shaft 17 through a chain 19 and chain wheels 18 and 21 carrying the chain 19 to a crank wheel 22 fixed to a shaft 20, a crank arm 23 pivotally mounted at a point 25 on the periphery of the crank wheel 22 and to the middle point 24 of the connector bar 13.

Thus, when the motor shaft 17 rotates at a constant speed, the crank wheel 22 will rotate to cause the crank arm 23 to reciprocate so that both piston rods 10 and 10' will also reciprocate and the first and second pistons 11 and 11' will carry out reciprocal motion simultaneously over the same stroke l between the points A and B.

Figure 2:
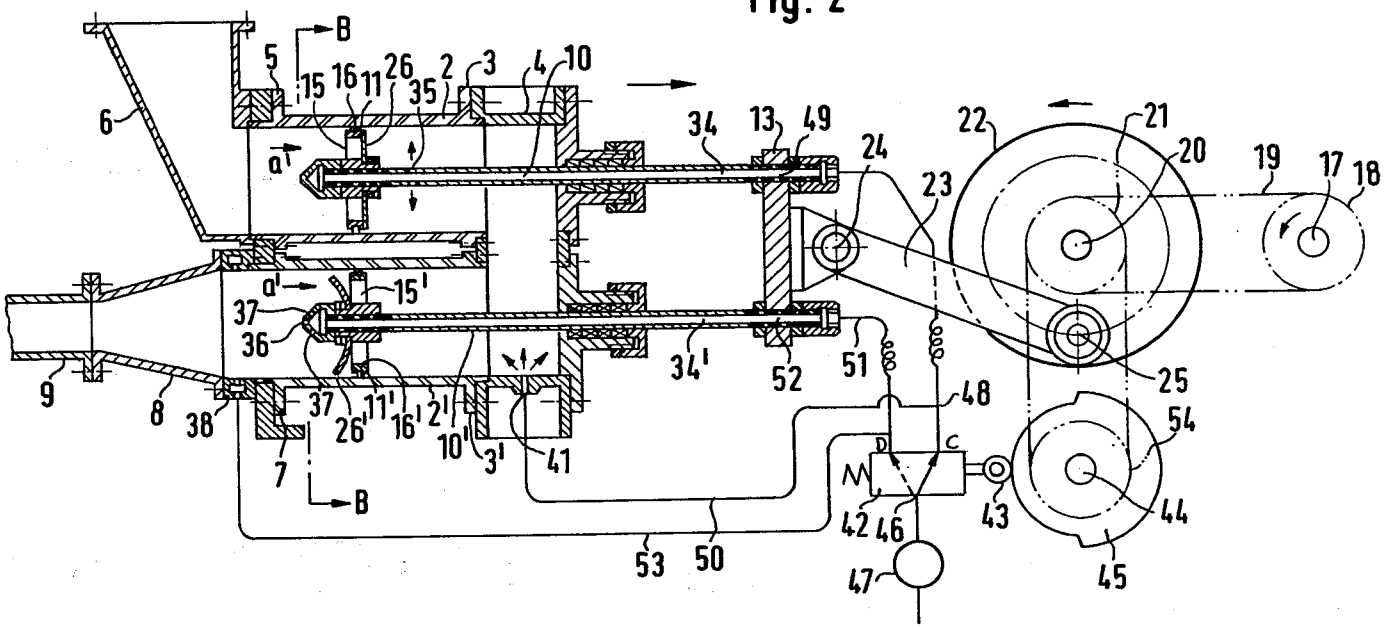
FIG. 2 is a view similar to FIG. 1 but with the pistons moving backwards.
Figure 3:
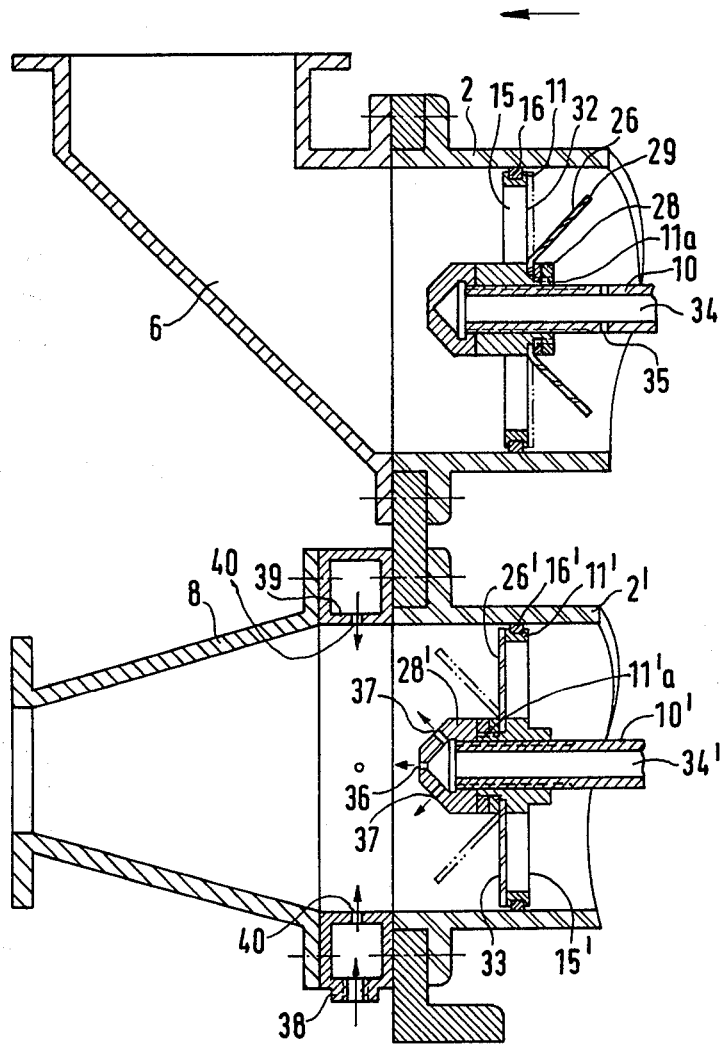
FIG. 3 is an enlarged sectional view of the portion of the device of FIGS. 1 and 2 enclosed by dotted lines "P"
Figure 5:
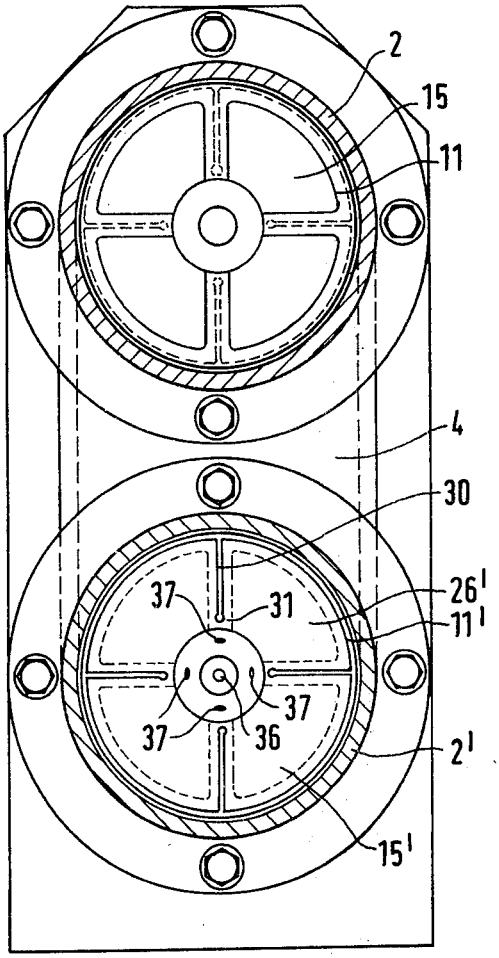
FIG. 5 is a cross-section taken along the line 5-5' in FIG. 2.
Figure 4:
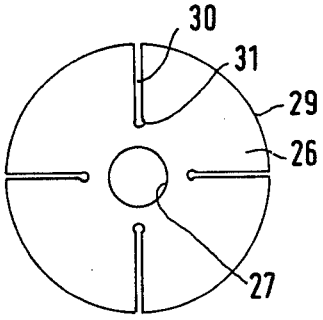
FIG. 4 is a front view of the flap valve of the device of FIG. 1.

As seen in FIGS. 3 and 4, a flap valve 26 of an elastic material, such as rubber, and simply referred to as a valve hereinafter, has a center hole 27 which is adapted to receive a boss 11*a* on the piston 11 attached to the piston rod 10, and the zone surrounding the center hole 27 is fastened to the boss on the rear side of the piston 11 by means of a ring nut 28. Further, valve vanes 29 are formed in valve 26 by a plurality (four in the illustrated embodiment) of cuts 30 from the periphery towards the center hole 27. The tendency of the valve to tear is prevented by holes 31 provided at the inner ends of the cuts. Each sector of the valve is freely flexible, and the cuts 30 are positioned with respect to the openings 15 in the piston 11 such that each cut 30 is located at the centerline between any adjacent two openings 15 and any sector of the valve 26 will just close the openings 15 of the piston when in the normal or undistorted state. A flap valve 26' is also provided on the piston 11' of the second cylinder 2' on the forward side of the piston 11' and a threaded cap 28' tightly fastens the flange valve 26' against a boss 11*a'* on the piston 11' attached to the piston rod 10'. Both the piston rods 10 and 10' are tubular and have inner spaces 34 and 34' through which compressed air can flow. Radial nozzles or holes 35 are provided in the rod 10 to the rear of the piston 11 for communicating the tubular space within the piston rod with the space within the first cylinder 2. A small forwardly directed nozzle or hole 36 is provided in the threaded cap 28' fitted over the front end of the second piston rod 10' and a plurality of small nozzles or holes 37 which are directed forward at an angle to the axis the piston rod 10' are also provided in the threaded cap 28'. Between the front end of the second cylinder 2' and the material outlet funnel 8 is provided an annular hollow air flange 38, the radially inner wall 39 of which has a plurality of air flange nozzles 40 therein directed radially inwardly for jetting compressed air radially inwards. The compressed air is fed to the connector box 4 and flange 38 from an air source 47 through a mechanical valve 42 and supply tubes 50 and 53. An inlet hole 41 is provided at a suitable point in the connector box 4 (at a bottom point thereof in the illustrated example) for admitting the compressed air into the connector box 4. The mechanical valve is provided at a suitable position in the vicinity of the first and second cylinders for controlling the flow of compressed air from the source 47 and switching it either to the inlet tube 50 or 53. The mechanical valve 42 is provided with a valve actuator 43, which is controlled by a cam 45 which is fixed to a cam shaft 44. A chain wheel 54 on the cam shaft 44 having the same diameter as that of the chain wheel 21 mounted on the shaft 20 is connected by a chain 54*a* to chain wheel 21 so that the cam shaft 44 rotates at the same speed as the shaft 20, for controlling the flow of the compressed air in synchronism with the reciprocation of the first and second pistons 11 and 11'. The cam 45 rotates in contact with the valve actuator 43, so that the valve actuator 43 is given a reciprocal motion by the cam 45 during rotation of the cam, whereby the compressed air supplied from the air source 47 through a supply inlet 46 in the mechanical valve 42 is switched between the outlets C and D of the mechanical valve 42 during each revolution of the cam shaft 44. That is to say, when the first and second pistons 11 and 11' are advancing in the direction of the arrow "a", the air flow is switched to the outlet D of the mechanical valve 42 (FIG. 1), and when the pistons are moving in the direction of the arrow "a'", the air flow is switched to the outlet C thereof (FIG. 2). The outlet C of the mechanical valve 42 is connected through a flexible hose 48 to the rear end 49 of the first piston rod 10 and the outlet C is also connected through the tube 50 to the inlet hole in the connector box 4, and the outlet D of the mechanical valve 42 is connected through a flexible hose 51 to the rear end 52 of the second piston rod 10' and the outlet D is also connected through the tube 53 to the air flange 38. When the mechanical valve 42 is switched to the outlet C the compressed air is supplied through the hose 48 and the holes 35 in the piston rod 10, and through the tube 50 and the inlet hole 41 into the first cylinder 2 and the connector box 4, and when the mechanical valve 42 is switched to the outlet D the compressed air is supplied through the hose 51 and the nozzles 36 and 37 at the front end of the rod 10', and through the tube 53, the air flange 38 and the air flange nozzles 40 into the second cylinder 2', thereby to fluidize the powdery or granular material to accelerate the movement thereof towards the outlet funnel 8.

Accordingly, the powdery or granular material is effectively propelled very smoothly by the compressed air jetted thereagainst in synchronism with the reciprocation of the first and second pistons 11 and 11' so as to increase the efficiency of propulsion of the material.

The operation and effect of the apparatus will now be described in further detail.

When the first piston 11 is driven in a direction to advance toward the material inlet 6 the powdery or granular material as indicated by the arrow "a", or from the lower dead center point B to the upper dead center point A, as indicated at the top of FIG. 1, the flap valve 26 mounted on the backside of the first piston 11 has the sectors flexed backward to uncover the openings 15 as shown in FIG. 1, so that the material is driven through the openings 15 into the first cylinder 2 to the rear of the first piston 11. Because at that moment no communication has been provided between the compressed air supply inlet 46 and the outlet C of the mechanical valve 42, no compressed air is jetted through the nozzle holes 35 in the first piston rod 10 nor through the inlet hole 41 provided in the connector box 4. On the other hand, when the second piston 11' advances towards the material outlet funnel 8 in the direction indicated by the arrow "a'" simultaneously with the first piston 11, the powdery or granular material filling the cylinder space in front of the second piston 11' is propelled through the material outlet funnel 8 into the transport pipe 9, because the flap valve 26' mounted on the front side of the second piston 11' is pushed against the front face 33 of the second piston 11' so as to be closely contiguous to the face 33, thereby shutting off the inlet opening 15' entirely. Because the inner space of the second cylinder 2' is expanded in accordance with the above motion, there is produced increased efficacy of the transfer of the material from the front side of the first piston 11 through the openings 15 into the first cylinder 2. Because the compressed air supply inlet 46 and the outlet D of the mechanical valve 42 are at this time connected as described above, the compressed air from the outlet D flows through the hose 51 and space 34' in the second piston rod 10', and is jetted from the holes 36 and 37 at the front end of the piston rod 10' against the powdery or granular material in front of the second piston 11', whereby the material in front of the second piston 11' within the second cylinder 2' is fluidized and propelled and is accelerated due to the combined effect of fluidization and propulsion and is thus vigorously transferred through the material outlet funnel 8 to the transport pipe 9. The compressed air from the outlet D of the mechanical valve 42 flowing through the tube 53 into the air flange 38 and jetted through the air flange nozzle 40 against the material causes fluidization of the material in front of the second piston 11' and provides a much smoother propulsion of the material.

Figure 6:
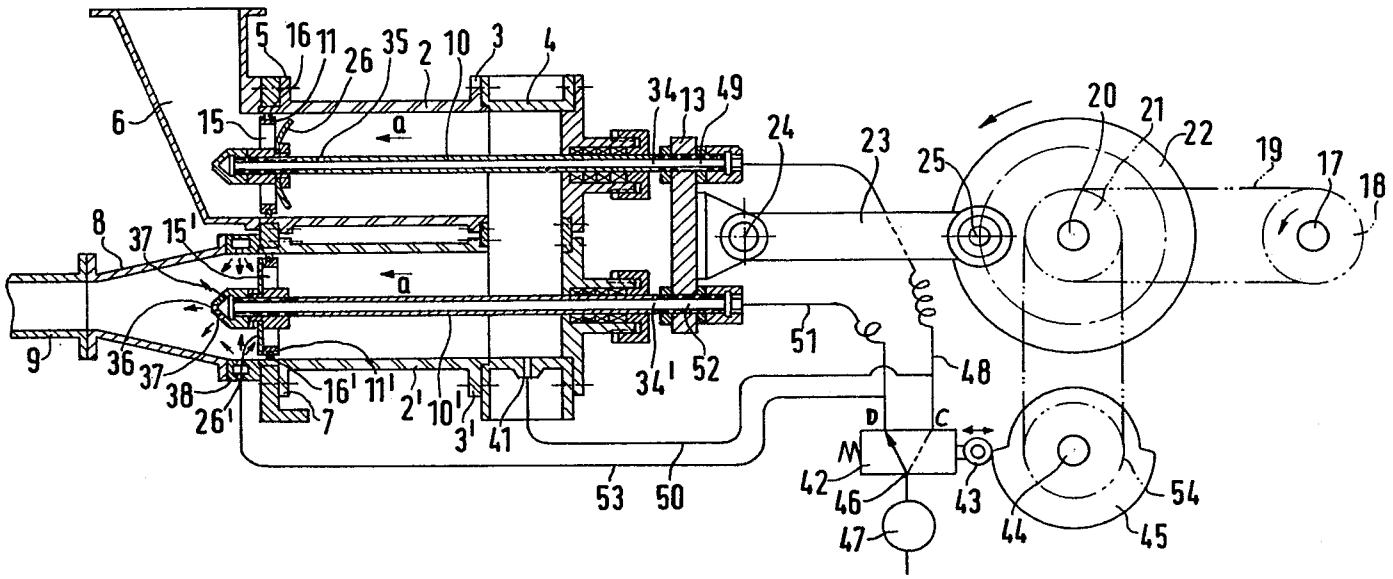
FIG. 6 is a view similar to FIG. 1 with the pistons in the forward dead center portion.
Figure 7:
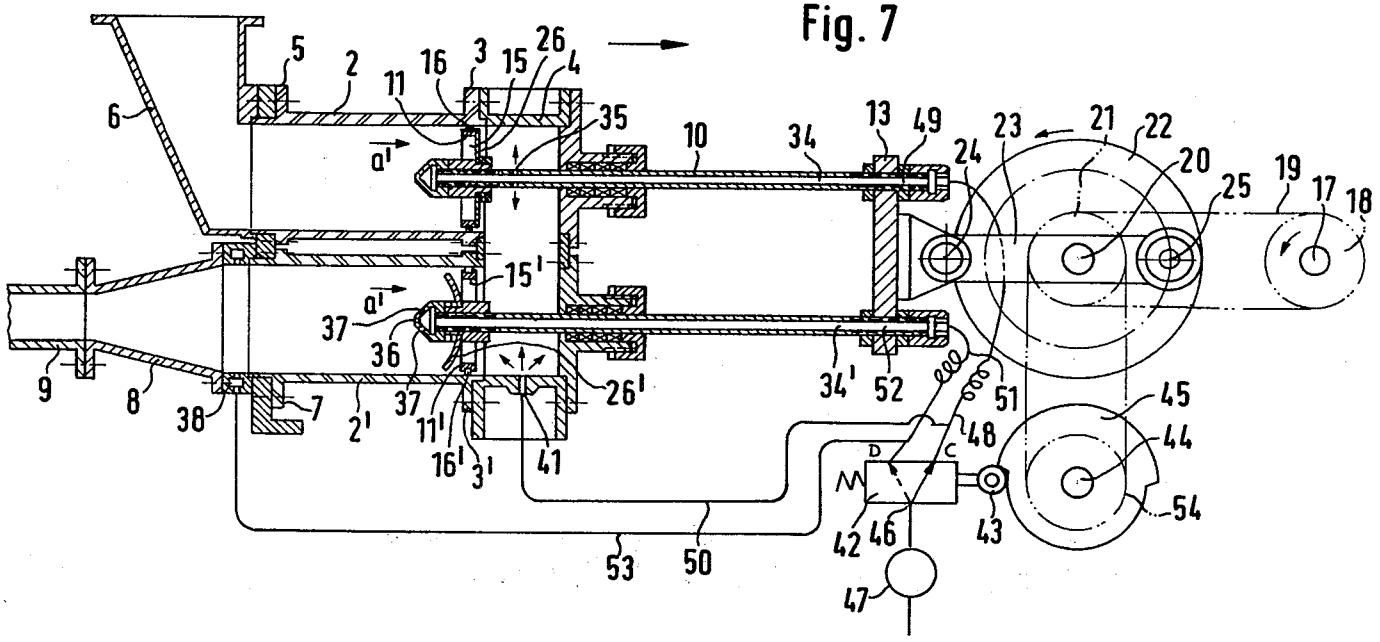
FIG. 7 is a view similar to FIG. 1 with the pistons in the rearmost dead center position.

Because when the pistons 11 and 11' are driven in the direction of the arrow "a", the flap valve 26 of the first piston 11 is opened, and the valve 26' of the second piston 11' is closed, the space in the first cylinder 2, the connector box 4 and the second cylinder 2' is expanded and a low pressure is produced therein until the parts reach the positions as seen in FIG. 6. Accordingly, the material within the first cylinder 2 in front of the first piston 11 flows vigorously through the connector box 4 into the second cylinder 2'.

When the first and second pistons 11 and 11' are driven in a direction opposite to that described above, or from the upper dead center point A to the lower dead center point B in the direction indicated by the arrow "a'", the flap valve 26 closes against the rear side 32 of the first piston 11 to close the openings 15 in the piston, and the piston pushes the material which has been sucked into the first cylinder 2 rearwards into the connector box 4 and towards the second cylinder 2'. At the same time the space within the first cylinder 2 in front of the first piston 11 is expanded, creating a reduced pressure tending to draw material through the material inlet 6 into the cylinder space in front of the first piston 11. During the time the first piston 11 is moving through stroke, the compressed air supply hole 46 of the mechanical valve 42 is placed in communication with the outlet C, so that compressed air from the outlet C flows through the hose 48 and through the holes 35 so as to be jetted against the material within the connector box 4, whereby the powdery or granular material within the first cylinder 2 is fluidized so that the flow thereof through the connector box 4 and the second cylinder 2' to the space in front of the second piston 11' is accelerated.

During this time the second piston 11' also moves in the same direction as the first piston 11, being connected therewith, and, during the stroke towards the connector box 4, the flap valve 26' on the second piston 11' opens as shown in FIG. 2, so that the material driven through the first cylinder 2 and the connector box 4 into the second cylinder 2' is transferred into the cylinder space in front of the second piston 11' towards the material outlet funnel 8. During the course of such a transfer, it may be advantageous, depending on the properties of the powdery or granular material being pumped, to jet compressed air through the small inlet hole 41 provided at some suitable position in the connector box 4, the timing preferably being synchronized with the jetting of air through the holes 35 in the first piston rod 10. At this time no air is jetted from the holes 36 and 37 or from the air flange nozzle 40.

Further, because the flap valve 26 on the first piston 11 is closed during this period, counter flow of the material from the second cylinder 2' through the connector box 4 and the first cylinder 2 toward the material inlet 6 due to any back pressure is completely prevented.

Thus during the displacement of the first and second pistons 11 and 11' in the direction of the arrow "a'", the flap valve 26 on the first piston 11 is closed and the flap valve 26' on the second piston 11' is open, and the space within the first cylinder 2, the connector box 4 and the second cylinder 2' is contracted to move the material therein through the piston 11' into the space in front of piston 11' in second cylinder 2', while the space in front of the first piston 11 is expanded to reduce the pressure therein so that the material from the material inlet 6 is caused to flow smoothly into the first cylinder 2.

It will be seen that one cycle of the operation as described is accomplished by one reciprocal stroke of the pistons, which in turn is produced by one revolution of the crank wheel 22, the rate or rotation of which may be varied steplessly depending on the amount of material and the distance of transportation. The mechanical valve 42 is operated by means of the cam 45 on the cam shaft 44 driven synchronously with the crank wheel 22 during the reciprocation of the pistons 11 and 11' for jetting the streams of the compressed air against the material within the cylinders. The space within the first and second cylinders 2 and 2' and the connector box 4 is repeatedly contracted and expanded during the simultaneous reciprocation of pistons, so that the powdery or granular material is sucked through the material inlet 6 and propelled through the first and second cylinders and into the material outlet funnel 8 and into the transport pipe 9 efficaciously.

Depending on the properties of the material and the distance of transportation, the device according to the present invention may well be operated without the jets of compressed air. That is, the powdery or granular material may be efficiently pumped without the use of the jets of air through the holes 35 in the first piston rod 10, the compressed air inlet hole 41 in the connector box 4, the holes 36 and 37 at the forward end of the second piston rod 11' and the air flange nozzles 40 in the air flange 38.

There has thus been provided an apparatus which overcomes the deficiencies of the prior art systems, has a high efficiency, has a large mixing ratio, can operate continuously and with small or large amounts of material. To this end, the apparatus has first and second cylinders 2 and 2' disposed in parallel, the rear ends thereof being connected by the connector box 4, the first cylinder 2 having the material inlet opening 6 at the front end 5 thereof, the second cylinder 2' having the material outlet funnel 8 at the front end 7 thereof, the first and second pistons 11 and 11' having piston rods 10 and 10', respectively, and being adapted to simultaneously reciprocate together in the first and second cylinders 2 and 2', respectively, the pistons having the openings 15 and 15' therethrough and the resilient material flap valves 26 and 26', respectively, one being adapted to open and the other to close the openings 15 and 15' simultaneously and automatically during the reciprocation of the pistons, so that when the pistons are driven rearward, the powdery or granular material is sucked through the material inlet opening 6 into the first cylinder 2 and at the same time the material which has been passed through the opening 15 in the first piston 11 into the first cylinder 2 is shifted through the connector box 4 and the openings 15' in the second piston 11' toward the space within the second cylinder 2' in front of the second piston 11', the flap valve 26' on the second piston being open during the rearward stroke thereof, and during such a rearward stroke compressed air is jetted from the holes 35 in the first piston rod 10 into the first cylinder 2 and also into the connector box 4 to cause the material to be fluidized to accelerate it in its transfer towards the space in front of the second piston 11' of the second cylinder 2', and when pistons are driven forward the material which has been sucked into the first cylinder 2 is shifted through the openings 15 in the piston 11 as the flap valve 26 opens into the space behind the first piston 11, and the material within the second cylinder 2' in front of the piston 11' is shifted towards the material outlet funnel 8 so that the space within the two cylinders and the connector box 4 is expanded during the simultaneous movement of the pistons and the material sucked through the material inlet 6 is eventually propelled through the material outlet funnel 8 to the transport pipe 9, and compressed air is jetted from the holes 36 and 37 at the front end of the piston rod 10' and from the air flange nozzles 40 in the air flange 38 against the material in front of the piston 11' thus facilitating the acceleration of the material being propelled through the material outlet funnels to the transport pipe 9.

This invention is believed to be far superior to known similar methods and devices in that two cylinders disposed in parallel are driven by a common crank arm, propulsion of powdery or granular material is greatly facilitated by the timed jetting of compressed air against the material and the system is comparatively simple and very effective and can easily be mass produced.

What is claimed is:

1. An apparatus for pumping a powdery or granular material, which comprises:

a first cylinder having a material inlet means at the front end and a second cylinder having a material outlet means at the front end, said first and second cylinders being parallel to each other;

a connector box connecting the rear ends of said cylinders for placing them in communication;

first and second pistons in said first and second cylinders, respectively, and having first and second piston rods connected to the respective first and second pistons and extending rearward from the pistons out of the cylinders;

means connected to said first and second piston rods for reciprocating said first and second pistons simultaneously in the same directions within the respective first and second cylinders;

said first and second pistons each having openings therethrough and the opening of said first piston being provided with a one-way valve which is normally closed and which is opened when said first piston is moving in the forward direction, and the opening of said second piston being provided with a one-way valve which is normally closed and which is opened when said second piston is moving in the rearward direction, one of said first and second piston rods being hollow and having at least one opening therein on the side of the piston on said one piston toward which that piston moves with the one-way valve thereon closed; and a compressed air supply means connected to the hollow interior of said one piston rod.

2. An apparatus as claimed in claim 1 in which said one piston rod is said first piston rod and said opening is to the rear of said first piston.

3. An apparatus as claimed in claim 1 in which said one piston rod is said second piston rod, and said second piston rod extends forward of said second piston, and said opening is forward of said second piston.

4. An apparatus as claimed in claim 1 in which both said first and said second piston rods are hollow, and said first piston rod has said opening to the rear of said first piston, and said second piston rod extends forward of said second piston and said opening is forward of said second piston, and said compressed air supply is connected to the hollow interior of both said first and said second piston rods.

5. An apparatus as claimed in claim 1 further comprising means for injecting compressed air into said connector box.

6. An apparatus as claimed in claim 1 further comprising means for injecting compressed air into the front end of said second piston.

7. An apparatus as claimed in claim 1 further comprising mechanical valve means in said compressed air supply means, said mechanical valve means being synchronized with the reciprocation of said first and second piston rods.

* * * * *